US009751116B2

(12) United States Patent
MacNeil et al.

(10) Patent No.: US 9,751,116 B2
(45) Date of Patent: Sep. 5, 2017

(54) PIPE MATERIAL REMOVAL APPARATUS AND METHOD

(71) Applicant: Mac & Mac Hydrodemolition Inc., Surrey (CA)

(72) Inventors: David MacNeil, Langley (CA); Jerry MacNeil, Surrey (CA); Gordon MacNeil, Surrey (CA); Jesse MacNeil, Surrey (CA); Brett MacNeil, Surrey (CA); Vernon Bose, Langley (CA)

(73) Assignee: Mac & Mac Hydrodemolition Inc., Surrey, CA (US)

( * ) Notice: Subject to any disclaimer, the term of this patent is extended or adjusted under 35 U.S.C. 154(b) by 960 days.

(21) Appl. No.: 13/795,242

(22) Filed: Mar. 12, 2013

(65) Prior Publication Data

US 2014/0261559 A1 Sep. 18, 2014

(51) Int. Cl.
*B08B 9/043* (2006.01)

(52) U.S. Cl.
CPC ..... *B08B 9/0433* (2013.01)

(58) Field of Classification Search
CPC ..... B08B 9/0433
See application file for complete search history.

(56) References Cited

U.S. PATENT DOCUMENTS 3,427,763 A * 2/1969 Maasberg ..... B24C 1/086 451/40
3,835,587 A * 9/1974 Hall, Jr. ..... B24C 3/325 451/38
4,064,293 A * 12/1977 Nicklas ..... B05B 13/0627 118/DIG. 10
4,380,477 A * 4/1983 Saunders ..... B24C 5/02 134/7
4,508,577 A * 4/1985 Conn ..... B08B 9/035 134/1
7,320,329 B2 * 1/2008 Luke ..... B08B 3/024 134/113
8,048,234 B2 * 11/2011 Jacquinet ..... B08B 9/0433 134/167 C
2005/0252531 A1 * 11/2005 Landaas ..... B08B 9/027 134/22.11
2012/0103153 A1 * 5/2012 MacNeil ..... B05B 3/06 83/53

FOREIGN PATENT DOCUMENTS

JP 2007308960 A * 11/2007

* cited by examiner

*Primary Examiner* — Alexander Markoff
(74) *Attorney, Agent, or Firm* — Smiths IP

(57) ABSTRACT

Apparatus for removing material lining the inside surface of a cylindrical structure, the apparatus comprising: a support for supporting the structure in a horizontal orientation; an elongate horizontal boom for being inserted into the structure; a nozzle assembly connected to the boom member, the nozzle assembly comprising one or more nozzles wherein each nozzle is suitably spaced from the lining to deliver a jet of fluid under pressure to the lining; a conduit in fluid communication with the nozzle assembly suitable for delivering a flow of fluid to each nozzle under sufficient pressure to cut the lining material adjacent the nozzle; and a rotation mechanism cooperating with the support to passively enable the structure to being rotated while supported by the support or to actively impart rotation to the structure while supported by the support, wherein the rotation of the structure is about a central longitudinal axis of the structure.

8 Claims, 6 Drawing Sheets

PIPE MATERIAL REMOVAL APPARATUS AND METHOD

BACKGROUND OF THE INVENTION

1. Field of the Invention

The field of the invention is hydro-demolition devices and methods for removing lining material from within pipe segments, particularly pipe segments used in pipeline applications.

2. Description of Related Art

Hydro-demolition—or hydraulic demolition—is a well known art practiced by forcing a liquid, typically water, through one or more nozzles at sufficiently high pressure to produce a jet stream that erodes or disintegrates the constituent material, such as concrete and the like, of which buildings and other structures are made.

The use of various materials to line conduits such as pipelines and the like is well known and essential in many industries. For instance, in the field of piping crude or diluted bitumen from tar sands extraction to a storage facility or refinery, the internal surface of the metal pipe segments (each segment being typically 50 feet in length) that comprise the pipeline are often lined with a layer of a rubber compound (usually about 0.25 inches thick) that is adhered to the metal on the inside of the pipe, followed by a urethane layer (usually about 0.75 inches thick) that is adhered to the rubber layer. In other applications, the lining material may vary in thickness, composition or in other aspects. The lining of the pipelines wears or deteriorates over time, and it becomes necessary to periodically remove and replace the affected pipe segments in the pipeline. It would be advantageous to be able to remove the worn lining from the affected pipe segment so that it can be remanufactured with a replacement lining or reused as an unlined pipe segment in other applications. Consequently, a system and a method are needed to quickly and efficiently remove the lining material from pipe segments.

The present invention is such a system and method that employs hydro-demolition techniques and novel equipment in order to exploit the power of hydro-demolition.

SUMMARY OF THE INVENTION

In some aspects, the present invention provides an apparatus for the removal of material lining the inside surface of a cylindrical structure, the apparatus comprising: a support for supporting the structure in a horizontal orientation; an elongate horizontal boom for being inserted into the structure; a nozzle assembly connected to the boom member, the nozzle assembly comprising one or more nozzles wherein each nozzle is suitably spaced from the lining to deliver a jet of fluid under pressure to the lining; a conduit in fluid communication with the nozzle assembly suitable for delivering a flow of fluid to each nozzle under sufficient pressure to cut the lining material adjacent the nozzle; and a rotation mechanism cooperating with the support to passively enable the structure to being rotated while supported by the support or to actively impart rotation to the structure while supported by the support, wherein the rotation of the structure is about a central longitudinal axis of the structure.

In some embodiments, the apparatus further includes a movement mechanism cooperating with the nozzle assembly for moving the nozzle assembly along the length of the boom within the structure. In some embodiments, the apparatus further includes a carriage assembly moveably connected to the boom and received within the structure, wherein the nozzle assembly is received on the carriage assembly and the carriage assembly is moved by the movement mechanism along the boom so that the nozzle assembly traverses along the length of the structure. In some embodiments, the boom defines a track and the carriage assembly is received on the track. The movement mechanism may comprise a cable provided within the structure that is connected to the carriage assembly and the cable is drawn along the length of the structure to impart movement to the carriage assembly. In other embodiments, the movement mechanism may comprise a drive mechanism on the carriage assembly that cooperates with the boom to impart movement to the carriage assembly relative to the boom.

In some embodiments, the movement mechanism cooperates with the boom for moving the boom with the nozzle assembly in a longitudinal direction relative to the structure. In some embodiments, a centering assembly is included for locating the nozzle assembly within the structure in a manner that maintains the nozzle at a suitable distance from the lining material yet allows the nozzle assembly to be moved along the length of the structure. The centering assembly may comprise one or more engagement members for contacting the inside surface of the structure or the lining material, and an extension mechanism cooperating with each engagement member to provide a biasing force to the engagement member towards the inside surface of the structure or the lining material. The centering assembly may further comprise a frame having at least three engagement members radiating outward from the frame in a manner to position the frame centrally within the structure, and the nozzle assembly includes a plurality of nozzles and is connected to the frame such that the nozzles are approximately equidistant from the longitudinal central axis defined by the structure. In some embodiments, each engagement member comprises a wheel assembly having a wheel configured to roll along the lining material as the apparatus is moved within the structure.

In some embodiments, the movement mechanism cooperates with the support for moving the structure in a longitudinal direction relative to the nozzle assembly. In some embodiments, a centering assembly is included for locating the nozzle assembly within the structure in a manner that maintains the nozzle at a suitable distance from the lining material yet allows the nozzle assembly to be moved along the length of the structure. The centering assembly may comprise one or more engagement members for contacting the inside surface of the structure or the lining material, and an extension mechanism cooperating with each engagement member to provide a biasing force to the engagement member towards the inside surface of the structure or the lining material.

In some embodiments, the nozzle assembly comprises: a first set of nozzles and a first high pressure conduit in fluid communication with the first set of nozzles; a second set of nozzles and a second high pressure conduit in fluid communication with the second set of nozzles; and wherein the first high pressure conduit is connected to a first source of high pressure fluid and the second high pressure conduit is connected to a second source of high pressure fluid such that the first set of nozzles may be operated at a different pressure than the second set of nozzles.

In another aspect, the present invention provides a method of removing lining material from the inside surface of a cylindrical structure, the method comprising the steps of: supporting the structure in a manner that allows for rotation of the structure about its central longitudinal axis; providing a nozzle within the structure and connecting the nozzle to a source of pressurized fluid; positioning the nozzle so that it remains at a constant distance from the lining as the structure is rotated, wherein the distance of the nozzle from the lining is suitable to deliver a jet of fluid under pressure to the lining; applying pressurized fluid to the nozzle such that a jet of fluid is forced against the lining material adjacent the nozzle, wherein the pressure of the fluid is sufficient to remove said lining material; rotating the structure so that the jet of fluid cuts a swath in the lining material; repositioning the nozzle longitudinally over the lining material, either by moving the nozzle or the structure, such that the jet of fluid is positioned to cut a new swath of lining material; and repeating the previous three steps until a desired amount of lining material within the structure is removed. The rotation of the structure and the repositioning of the nozzle may be synchronized such that the jet of fluid cuts a continuous, overlapping helical swath of the lining material in a continuous motion.

BRIEF DESCRIPTION OF THE DRAWINGS

For a better understanding of the present invention and to show more clearly how it may be carried into effect, reference is made by way of examples to the accompanying drawings in which.

DETAILED DESCRIPTION OF THE INVENTION

Figure 1:
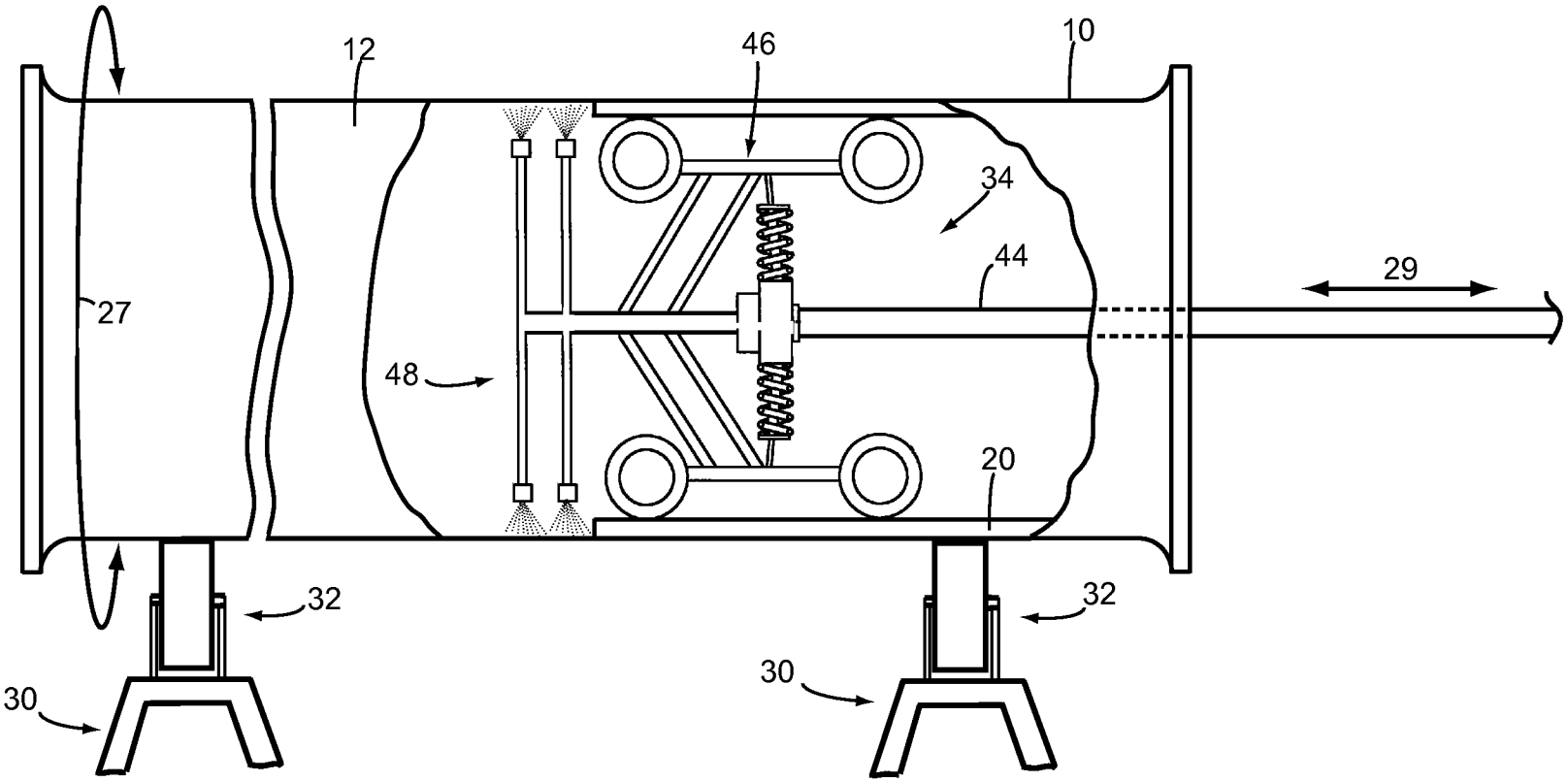
FIG. 1 is a cross-sectional simplified view of an embodiment of an apparatus in accordance with the present invention within a cylindrical pipe segment in which the lining material has been partially removed.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention. The terms "cut," "cutting," and "cutter," etc. as used herein refer to the use of hydro-demolition technology to remove lining material from a pipe or other structure.

Figure 2:
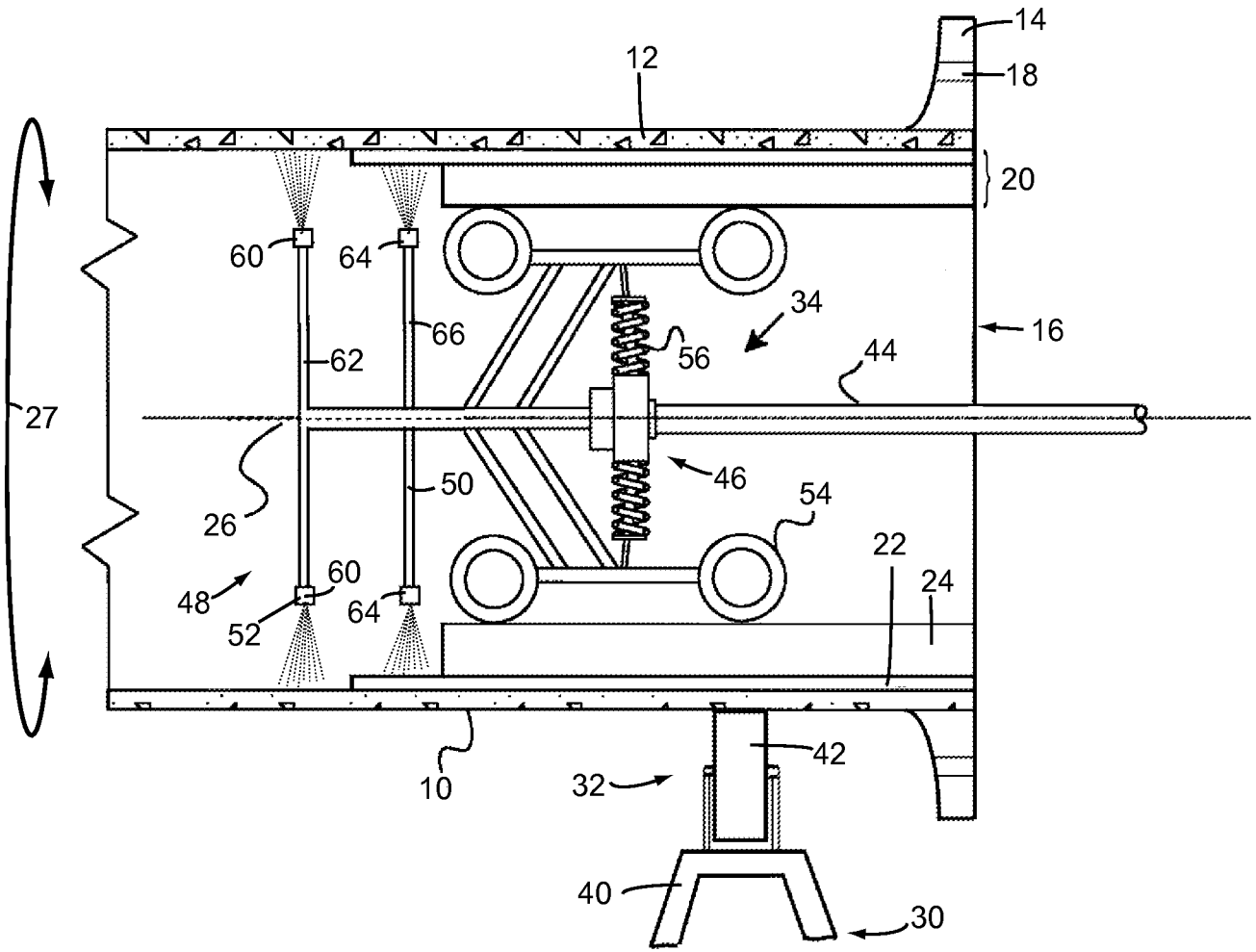
FIG. 2 is an expanded view of the apparatus and pipe segment of FIG. 1.
Figure 3:
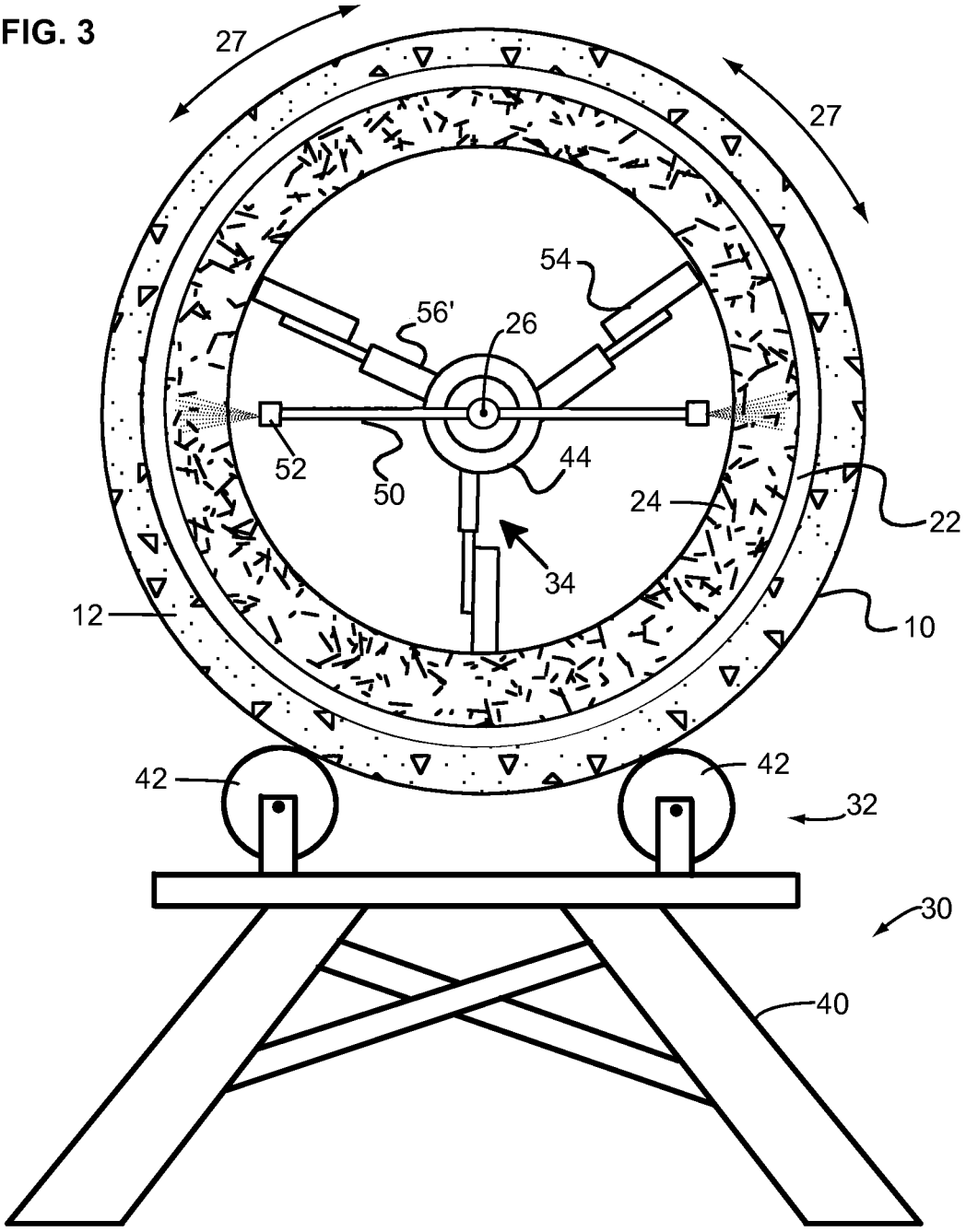
FIG. 3 is a side view looking along the apparatus of FIG. 1 in the horizontally oriented pipe segment, wherein the layers of the lining material and pipe segment appear as concentric rings about a central longitudinal axis.

With reference to FIGS. 1-3, a cylindrical structure such as pipe segment 10 is shown in cross-sectional view (FIGS. 1 & 2) and in side view (FIG. 3). The cylindrical pipe segment 10 comprises a cylindrical wall 12, usually of steel or other suitable rigid material, that provides structural strength and rigidity to the pipe segment 10. The pipe segment 10 typically includes an external circumferential flange portion 14 at each open end 16 of the pipe segment having a plurality of openings 18 through which multiple adjacent pipe segments can be bolted together to define a pipeline. On the inside surface of the wall 12 is provided a lining material 20, which in the illustrated pipe segment 10, comprises a rubber layer 22 adhered to the interior surface of the wall 12 and a urethane layer 24 adhered to the rubber layer 22. As shown in FIG. 3 the wall 12, the rubber layer 22 and the urethane layer 24 appear as concentric rings about a central axis 26. Pipe segments of the kind illustrated are used in pipelines for conveying diluted bitumen after it has been extracted from oil (or "tar") sands to a storage/shipping facility or refinery. Typically, the pipe segments are 50 feet long but they may be longer or shorter. As well, depending on the application of the pipeline, the pipe segments may comprise of only one layer of lining material, or they may have a plurality of layers or lining material. While the present invention is described and illustrated in application to pipe used in pipelines for moving diluted bitumen, the scope of the invention goes beyond pipelines.

The embodiments of the invention generally comprises a support 30 that supports the pipe segment 10 in a desired orientation, usually horizontally, a rotation mechanism 32 connected to or cooperating with the support 30 that enables rotation of, or actively rotates, the pipe segment about its central longitudinal axis 26 (as shown by arrows 27), and a hydro-demolition apparatus 34 that is adapted to being inserted into the pipe segment and to imparting one or more jets of high pressure fluid (usually water) against the lining material so that the lining material is fragmented and removed from the inside of the pipe to expose the core material of the pipe.

In the simplest of embodiments, the support 30 may comprise a one or more frame members 40 that are suitable for supporting the weight of a pipe segment in a desired orientation, preferably horizontally, and the rotation mechanism 32 may comprise a plurality of wheels or rollers 42 connected to the frame members on which the pipe segment rests, wherein the axis of rotation of each roller is parallel to the central longitudinal axis 26 of the pipe segment so that the pipe segment may be rotated about its central axis 26 by the application of force. Thus, in its simplest form, the rotation of the pipe segment can be achieved by application of force by one or more persons to the pipe segment itself. Alternatively, and preferably, one or more of the rollers 42 may be driven by a motor to impart the rotating force to the pipe segment via those motorized rollers. In more elaborate embodiments, the support 30 may comprise a stacking and conveying apparatus that is able to store a plurality of pipe segments and convey one pipe segment at a time to the rotation mechanism 32 for processing by the hydro-demolition apparatus 34.

In the embodiment illustrated in FIGS. 1-4, the hydro-demolition apparatus 34 includes an elongate rigid boom 44 that is connected at its proximal end to a support structure (not shown). The hydro-demolition apparatus 34 also includes a centering assembly such as traveler 46 that is connected to the remote end of the boom 44, and a nozzle assembly 48 that is carried by the traveler 46. The boom 44 may be of a length sufficient to span the pipe segment so that it may be inserted in one end and enable the nozzle assembly 48 to reach the other end of the pipe segment.

Nozzle assembly 48 comprises one or more rigid nozzle lines 50 connected to nozzles 52. The nozzle assembly 48 is carried on the traveler 46. One function of the traveler is to allow the nozzle assembly to ride within the pipe segment along the central axis 26 and thereby keep the nozzles 52 suitably spaced from the lining material 20 in order to deliver a jet of fluid under sufficient pressure to cut the lining material. The fluid, which is typically water, is delivered to the nozzle assembly by a conduit means (not shown), such as pipes or hoses, which may be routed within the boom 44 or adjacent to it.

Referring to FIG. 3, the illustrated embodiment of traveler 46 comprises a chassis or frame having engagement members such as wheels 54 attached thereto. In the embodiment shown, three sets of wheel assemblies are employed. The wheel assemblies are radially spaced by being positioned at approximately equivalent intervals (120° intervals as illustrated in FIG. 3) about the inner circumference of the pipe segment 10. In this way, the center of the traveler can be maintained approximately coincident with the central axis 26 of the pipe. The number of wheel assemblies can vary depending on the shape of the diameter of the pipe so long as there are at least a sufficient number to keep the traveler 46, particularly the nozzle assembly 48, approximately centered in the pipe member.

Figure 4:
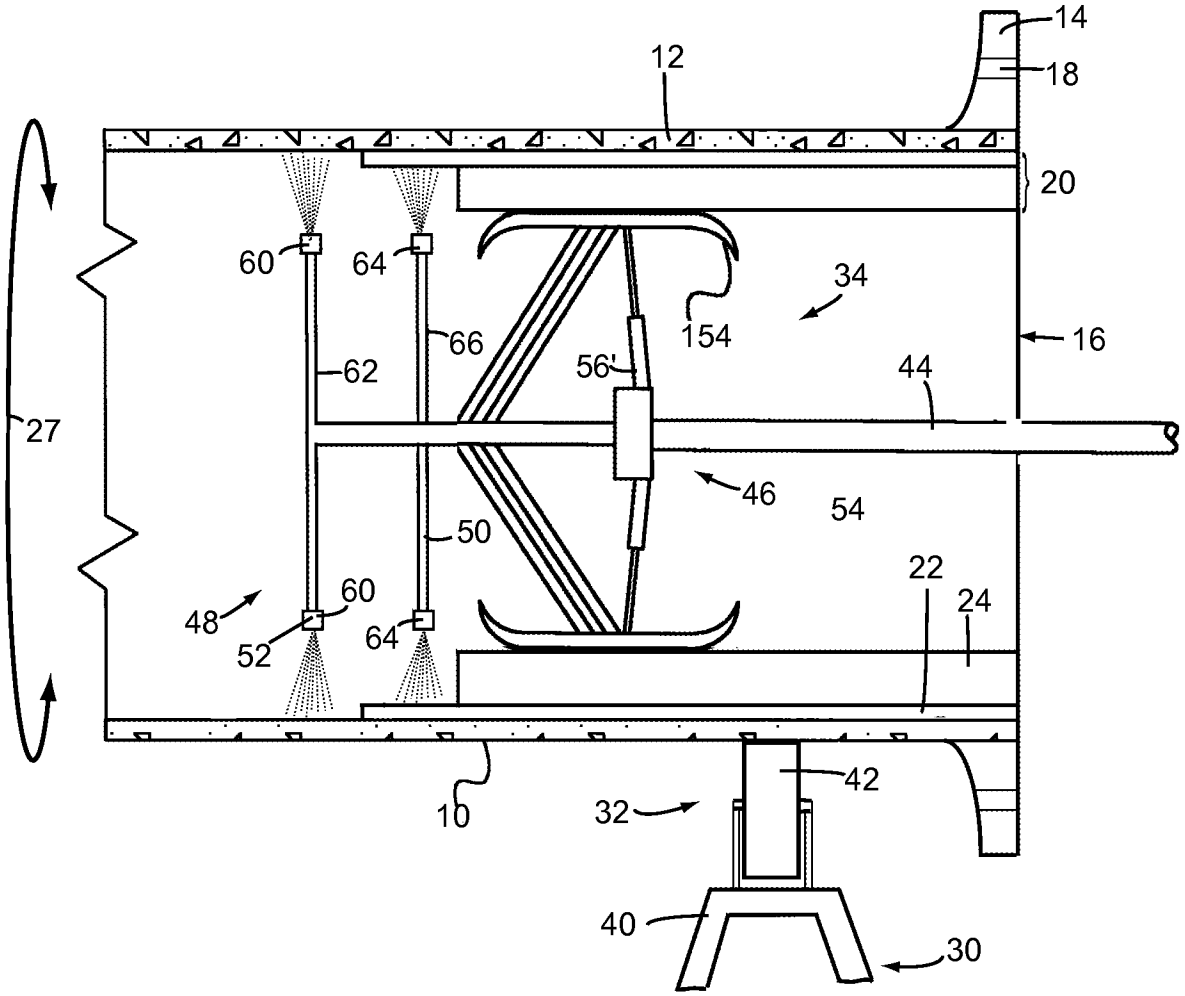
FIG. 4 is a cross-sectional simplified view of another embodiment of an apparatus in accordance with the present invention within a cylindrical pipe segment in which the lining material has been partially removed.

The wheel assemblies may comprise one or more wheels, chassis members, and one or more extension mechanisms that bias or urge the wheels against the lining material 20. As shown in FIG. 2, spring 56 acts as an extension mechanism by putting slight pressure against the wheels, urging them against the lining material. Other devices for effectuating the extension mechanism may include hydraulic or pneumatic extenders or shock-absorber devices 56' such as shown in FIG. 4. Accordingly, the wheel assemblies together with the extension mechanisms locate the traveler within the structure in a manner that allows the traveler to be moved longitudinally as well as to slip within the pipe segment as it is rotated. In FIGS. 2 and 3, the wheels 54 of the traveler are urged against the lining material, thereby keeping the traveler centered in the pipe member. The boom 44 holds the traveler at the appropriate position within the pipe segment.

Figure 6:
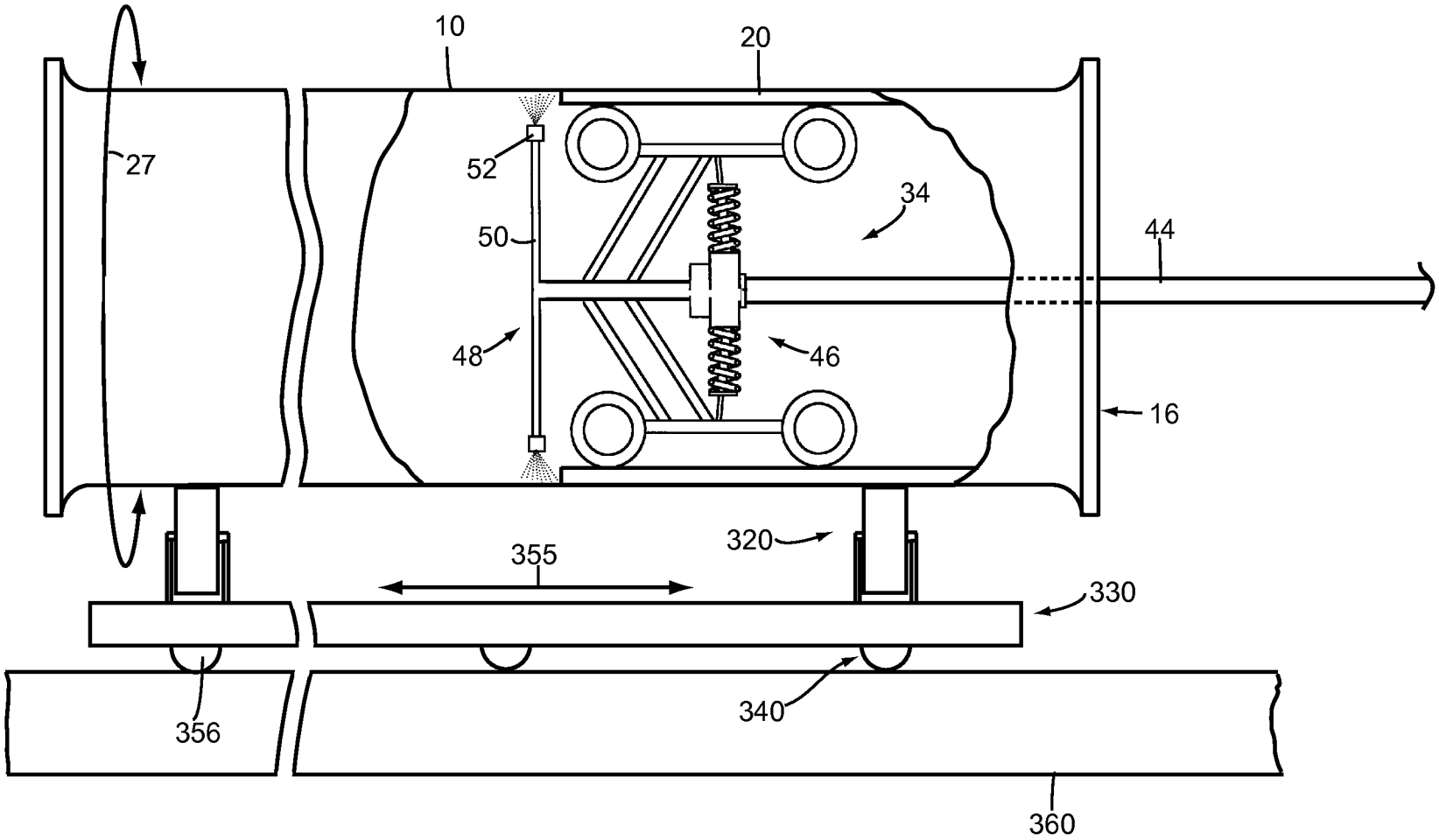
FIG. 6 is a simplified side view of another embodiment of an apparatus in accordance with the present invention and a pipe segment with a portion of the pipe wall cutaway exposing a portion of the apparatus within the pipe segment.

As shown in FIG. 2, the illustrated nozzle assembly 48 includes a first set of nozzles 60 fed by a first high pressure conduit or nozzle line 62, and a second set of nozzles 64 fed by a separate second high pressure conduit or nozzle line 66. Each nozzle line 62 and 66 is fed by its own separate source of high pressure fluid via its own conduit (not shown). This enables the nozzle heads 60 to be operated at a different pressure than the nozzle heads 64 if desired. For example, in the described and illustrated embodiment of a pipe segment, the urethane layer 24 requires a higher fluid pressure to be removed from the rubber layer 22 than does the rubber layer 22 require to be removed from the pipe material 12. Thus the nozzle heads 64 are operated at a higher pressure and operate to first remove the urethane layer 24 (as shown in FIG. 1). While the trailing nozzle head 60 are operated at a lower pressure to remove the rubber layer 22. In other multilayered linings, the inner layers may require less fluid pressure than the outer layers, thus the pressures of the nozzle heads 60 and 64 may be operated accordingly. As well, some lining material (whether or not multi-layered) may be removed by a single pressure, hence the nozzle heads 60 and 64 may be operated at the same requisite pressure, or one of the nozzle heads may be shut down, or omitted altogether from an embodiment hydro-demolition apparatus (as shown in FIG. 6).

In a horizontally oriented pipe segment, the traveler can be conveniently moved longitudinally along the length of the pipe segment by moving the boom 44 into our out of the pipe segment. The movement of the boom 44 is accomplished by a movement mechanism that cooperates with the boom and moves it (hence the nozzle assembly) in a longitudinal direction relative to the structure. The movement mechanism comprises any suitable mechanism that is operable to move the boom 44 longitudinally (as shown by arrows 29) within the cylindrical structure for a distance suitable to achieve removal of a desired amount of lining material. As an example, the end of the boom remote from the traveler may be connected to a track that is parallel to a longitudinal axis of the cylindrical structure and the boom is operable to slide or roll on the track so that the boom is moved longitudinally within the structure. As another example, the end of the boom remote from the traveler may be connected to a wheeled frame or vehicle which can move in a direction parallel to a longitudinal axis of the cylindrical structure so that the boom is moved longitudinally within the structure. An example of such wheeled vehicle may be a modified forklift or the like. It is contemplated that many structures and mechanisms may comprise the movement mechanism of the present invention.

The method of using the illustrated embodiment to remove lining material from a pipe segment includes the steps of: 1) providing the system; 2) inserting the traveler 46 supported by the boom member 44 into the pipe segment 10 until the nozzle assembly 48 is positioned at the remote end of the pipe segment with the center the nozzle assembly being approximately coincident with the central axis 26 of the pipe member; 3) applying fluid at a high pressure(s) to the nozzles 60 and/or 64 of the nozzle assembly through the conduit(s) whereby high pressure jets of the fluid are forced against the lining material 20 through the nozzles; 4) rotating the pipe member so that the jets of high pressure fluid cut a cylindrical swath of the lining material and 5) periodically withdrawing the boom member 44 for a short distance to reposition the traveler 46 and nozzle assembly longitudinally over the lining material so that the jets of high pressure are positioned to cut a new swath of lining material. The rotation of the pipe segment and the movement of the nozzle assembly may also be synchronized such that the jets of high pressure fluid cut continuous, overlapping helical swaths of the lining material in one continuous motion rather than in an indexed manner (such as is achieved by first rotating the pipe segment to cut one swath, moving the nozzles, rotating the pipe again to cut another swath, and repeating).

The pressure of the fluid will vary according to the thickness and other physical properties of the lining material. Generally, pressures between 20,000 psi and 40,000 psi may be sufficient. In many situations it may be preferred to begin the hydro-demolition process at the end of the pipe that is remote from the end in which the traveler was inserted and move the traveler sideways by withdrawing the boom from the pipe segment at a desired rate and manner. However, in some difficult cases it may be necessary to move the nozzles back and forth multiple times over a given length of lining material.

FIG. 4 shows another embodiment of the apparatus in accordance with the present invention. The traveler 146 in this embodiment has engagement members that comprise skids 154 instead of wheels. Accordingly, the skids together with the extension mechanisms locate the traveler within the structure in a manner that allows the traveler to be moved longitudinally as well as to slip within the pipe segment as it is rotated. The skids 154 have the advantage of reducing the number of moving parts of the traveler. In other embodiments, the engagement members my by a combination of skids and wheels, or other structures capable of locating the traveler within the structure in a suitable manner.

In some embodiments, the traveler may be omitted altogether if the boom member 44 is sufficiently rigid to maintain the nozzle assembly 48 in a desired position within the pipe member to enable cutting of the lining material by the jets of high pressure fluid.

Figure 5:
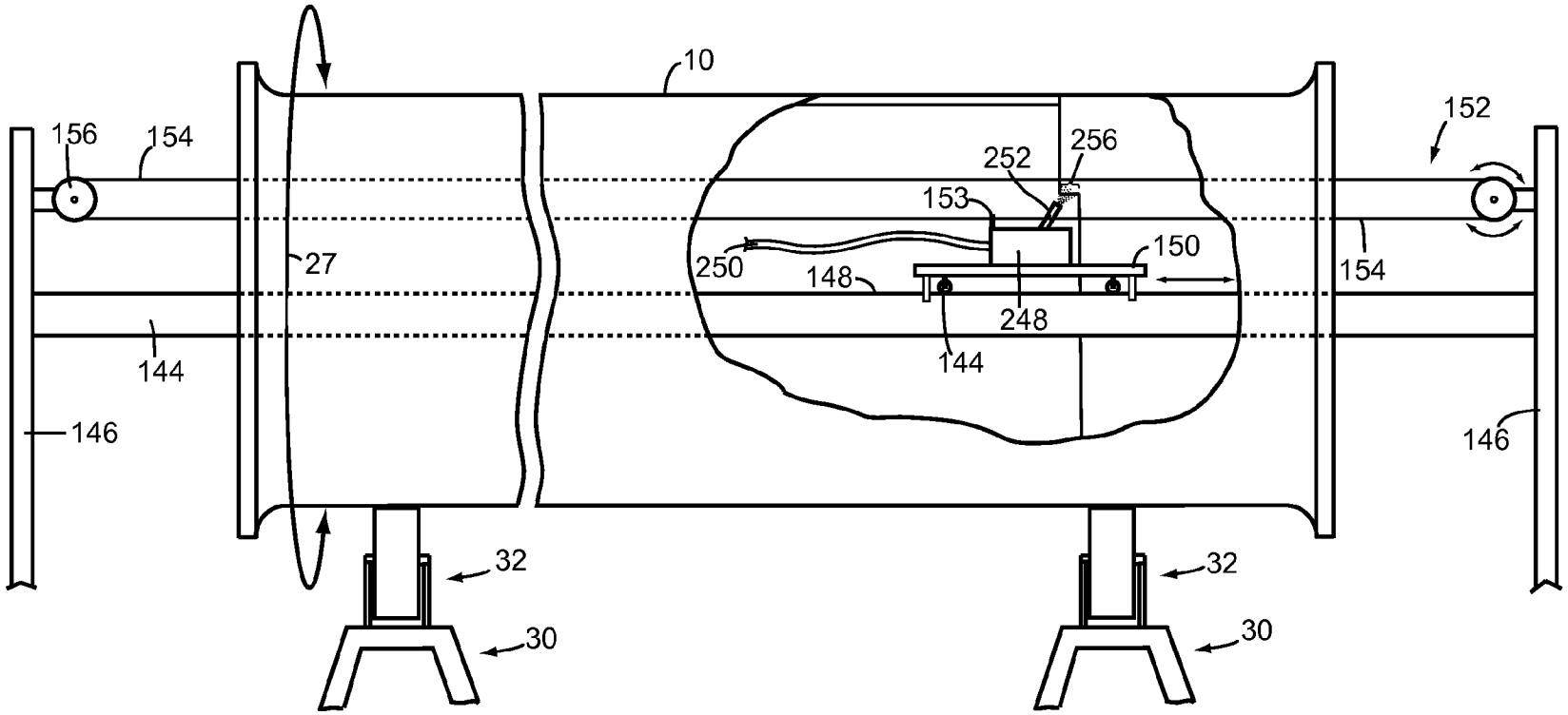
FIG. 5 is a simplified side view of another embodiment of an apparatus in accordance with the present invention and a pipe segment with a portion of the pipe wall cutaway exposing a portion of the apparatus within the pipe segment.

Referring to FIG. 5 there is shown another embodiment of an apparatus in accordance with the present invention, which generally comprises a support 30 that supports the pipe segment 10 in a desired orientation, usually horizontally, a rotation mechanism 32 connected to or cooperating with the support that enables rotation of, or actively rotates, the pipe segment about its central longitudinal axis 26, and a hydro-demolition apparatus 34 that is adapted to being inserted into the pipe segment and to imparting one or more jets of high pressure fluid (usually water) against the lining material so that the lining material is fragmented and removed from the inside of the pipe to expose the core material of the pipe. The support 30 and the rotation mechanism 32 are similar to the embodiment described above and illustrated in FIGS. 1-3, and the comments in relation thereto are applicable to this embodiment.

A long rigid boom 144 is removably mounted within the pipe segment parallel to its central axis, with portions of the boom 144 extending outside of the pipe segment at both ends that are secured by rigid boom supports 146 to maintain the boom along the desired longitudinal axis of the pipe segment. The boom 144 is releasably connected to one or both boom supports 146 to enable the boom to be inserted or withdrawn from the pipe segment. The boom 144 defines a track 148 extending the length of the boom or the portion thereof that is within the pipe segment. A carriage assembly 150 is mounted for movement along the track 148, in this case by rolling on wheels or rollers 144, and is moved there-along by a movement mechanism 152. In the illustrated embodiment, movement mechanism 152 comprises a cable 154 that runs parallel to the boom 144 and is mounted at the ends on drums or sheaves 156. The cable 154 is connected at a connection point 153 to the carriage assembly 150, and as the cable is rotated on the sheaves 156 by a motor (not shown) or other means that imparts rotation to one or more sheaves, it moves the carriage assembly 150 along the track 148. The cable may be drawn in either direction along the length of the pipe and thereby the carriage assembly 150 may be moved in either direction along the boom.

Nozzle assembly 248 is received or carried on the carriage assembly 150 and includes one or more nozzles 252. Accordingly, the movement mechanism cooperates with the nozzle assembly for moving the nozzle assembly in a longitudinal direction relative to the pipe segment such that the nozzle assembly traverses the length of the pipe segment along an axis parallel to the central longitudinal axis. The nozzles 252 are suitably spaced from the lining material 20 in order to deliver an optimum jet of fluid under sufficient pressure to cut the lining material. The fluid is delivered to the nozzle assembly by a conduit means 250, such as a pipe or hose, which may be routed within or adjacent to the boom 144.

In use, a pipe segment 10 is placed on the rollers 32 and the boom 144 is inserted into the pipe segment so that it spans the length of the pipe segment and each end of the boom 144 is connected to a rigid support 146. The carriage assembly 150 is mounted onto the track 148 of the boom 144, and the movement means 152 is also installed. In the illustrated embodiment, the cable 154 is run the length of the pipe segment, wound around the sheaves 156 at each end and then back along the pipe segment to define a continuous loop of the cable 154. The carriage assembly 150 is connected to the cable 154 such that it may be moved back and forth along the track 148 as the cable 154 is rotated, drawing the carriage assembly along. The conduit 250 for the high pressure fluid is connected to the nozzle assembly 248 to provide high pressure fluid to the nozzle 252. The conduit 250 is allowed some slack so it allows freedom of movement of the carriage assembly 150 as required, and so that it may be drawn into the pipe segment as the carriage assembly traverses the length of the pipe segment. The carriage assembly is aligned to a desired starting point along the pipe segment and the pressurized fluid is enabled so that a jet of high pressure fluid is emitted from the nozzle 252 and onto the lining 20 of the pipe to commence a cut therein (such as shown by 256). The pipe segment is rotated about its longitudinal axis by or on the rotation mechanism 32 while the carriage assembly 150 is kept stationary. As the pipe segment rotates, the jet of high pressure fluid cuts a swath 256 in the lining material 20. Once a complete rotation of the pipe is accomplished, or a desired swath of lining has been removed from the inside wall of the pipe segment, then the carriage assembly 150 is moved or indexed to the next location where a swath of lining is to be removed. For example, it could be moved to either side of the cut swath such that the high pressure jet slightly overlaps the cut swath, thereby widening it in the desire direction. This can be continued until the desired width of lining material has been removed. Alternatively, the carriage assembly can be moved at a constant continuous rate while the pipe segment is rotated such that a swath of lining material can be removed in one continuous, spiraling cut.

The movement mechanism in embodiments utilizing a movable carriage assembly on a fixed boom, such as illustrated in FIG. 5, may be any mechanism suitable to impart motion to the carriage assembly along the boom at a suitable rate and in a manner that does not interfere with the operation of the nozzles or the rotation of the cylindrical structure. For example, the carriage assembly may include an onboard drive mechanism that causes the carriage assembly to move on the boom, and which can be controlled by the operator. It is contemplated that many structures and mechanisms may comprise the movement mechanism of the present invention.

In other embodiments of the present invention, the nozzle assembly may be fixedly mounted on a boom within the pipe segment such that is remains stationary, and the pipe segment may be either indexed or continuously moved laterally, as well as rotated, to effect the desired cut of lining material. In such embodiments, the carriage assembly, the cable assembly and the track would not be required, and the movement mechanism would cooperate with the support. Thus, for example with reference to FIG. 6, there is illustrated another embodiment in which comprises support 330 that supports pipe segment 10. Rotation mechanism 320 is connected to or cooperates with the support 330 and enables rotation of, or actively rotates, the pipe segment about its central longitudinal axis. The device includes movement mechanism 352 that cooperates with the support 330 for moving the support and the pipe segment in a longitudinal direction as shown by 355. In the illustrated embodiment, the movement mechanism 352 comprises a series of wheels or rollers 356 on which the support is mounted and which roll on a surface or other structural member 360. In some embodiments, one or more of the rollers 356 may be driven by a motor to impart the rotating force to move the support. The hydro-demolition machine component is similar to the embodiment in FIGS. 1-3, comprising a traveler 46, nozzle assembly 48' (with only one set of nozzles illustrated) and a boom 44. The boom remains stationary while the pipe segment is moved longitudinally to effect movement of the nozzle assembly in relation to the pipe segment. The pipe segment is rotated on rotating mechanism 330. While a traveler 46 is shown, it may be omitted in other embodiments in which the nozzle assembly is mounted to a rigid boom having sufficient strength to support the nozzle assembly cantilevered in an operative position within the pipe segment.

The movement mechanism in embodiments utilizing a movable support, such as illustrated in FIG. 6, may be any mechanism suitable to impart motion to the support along a surface or on another structure. One example of such movement mechanism has been illustrated as 352 and described. Other examples may comprise of the support being mounted on a track or rail that is parallel to a longitudinal axis of the cylindrical structure and the support is operable to slide or roll on the track so that the structure is moved longitudinally relative to the nozzle assembly within the structure. It is contemplated that many structures and mechanisms may comprise the movement mechanism of the present invention.

The invention has been described here with respect to particular embodiments. Those of skill in the art will recognize that the scope of the invention extends beyond these particular embodiments. For instance, various forms and designs of booms, carriage assemblies, travelers and different types of nozzles will, upon reading this disclosure, be obvious to those of skill in the art for accomplishing the disclosed functions. The embodiments described and illustrated herein should not be considered to limit the invention but rather the scope of the invention is to be construed in accordance with the following claims.

What is claimed is:

1. An apparatus for removing material lining the inside surface of a cylindrical structure, the apparatus comprising:

a support for supporting said cylindrical structure in a horizontal orientation;

an elongate boom for being inserted into said cylindrical structure;

a nozzle assembly connected to said elongate boom, the nozzle assembly comprising one or more nozzles wherein each nozzle is spaced from said material to deliver a jet of fluid under pressure to said material;

a conduit in fluid communication with the nozzle assembly for delivering a flow of fluid to each nozzle under sufficient pressure to cut said material adjacent said each nozzle;

a rotation mechanism cooperating with the support to passively enable said cylindrical structure to be rotated while supported by the support or to actively impart rotation to said cylindrical structure while supported by the support, wherein the rotation of said cylindrical structure is about a central longitudinal axis of said cylindrical structure;

a movement mechanism cooperating with the nozzle assembly for moving the nozzle assembly along the length of said elongate boom within said cylindrical structure; and, further including a carriage assembly moveably connected to said elongate boom and received within said cylindrical structure, wherein the nozzle assembly is received on the carriage assembly and the carriage assembly is moved by the movement mechanism along said elongate boom so that the nozzle assembly traverses along the length of said cylindrical structure.

2. An apparatus for removing material lining the inside surface of a cylindrical structure, the apparatus comprising:

a support for supporting said cylindrical structure in a horizontal orientation;

an elongate boom for being inserted into said cylindrical structure;

a nozzle assembly connected to said elongate boom, the nozzle assembly comprising one or more nozzles wherein each nozzle is spaced from said material to deliver a jet of water under pressure to said material;

a conduit in fluid communication with the nozzle assembly for delivering a flow of water to each nozzle under sufficient pressure to cut said material adjacent said each nozzle; and a rotation mechanism cooperating with the support to passively enable said cylindrical structure to be rotated while supported by the support or to actively impart rotation to said cylindrical structure while supported by the support, wherein the rotation of said cylindrical structure is about a central longitudinal axis of said cylindrical structure;

and wherein said nozzle assembly comprises:

a first set of nozzles directed to impinge on said inside surface at a first location and a first high pressure conduit in fluid communication with the first set of nozzles;

a second set of nozzles spaced longitudinally in relation to said elongate boom from said first set of nozzles and directed to impinge on said inside surface at a position spaced from said first location and a second high pressure conduit in fluid communication with the second set of nozzles; and wherein the first high pressure conduit is connected to a first source of high pressure water and the second high pressure conduit is connected to a second source of high pressure water such that the first set of nozzles may be operated at a different pressure than the second set of nozzles.

3. The apparatus as claimed in claim 1, wherein said elongate boom defines a track and the carriage assembly is received on the track.

4. The apparatus as claimed in claim 3, wherein the movement mechanism comprises a cable provided within said cylindrical structure that is connected to the carriage assembly and wherein the cable is drawn along the length of said cylindrical structure to impart movement to the carriage assembly.

5. The apparatus as claimed in claim 3, wherein the movement mechanism comprises a drive mechanism on the carriage assembly that cooperates with said elongate boom to impart movement to the carriage assembly relative to said elongate boom.

6. The apparatus of claim 2 further including a movement mechanism cooperating with the nozzle assembly for moving the nozzle assembly along the length of said elongate boom within said cylindrical structure.

7. The apparatus of claim 2 further including a movement mechanism cooperating with said elongate boom for moving said elongate boom with the nozzle assembly in a longitudinal direction relative to said cylindrical structure.

8. The apparatus of claim 2 further including a carriage assembly moveably connected to said elongate boom and received within said cylindrical structure, wherein the nozzle assembly is received on the carriage assembly and the carriage assembly is moved by the movement mechanism along said elongate boom so that the nozzle assembly traverses along the length of said cylindrical structure.

* * * * *